US010118726B2

(12) United States Patent
James et al.

(10) Patent No.: US 10,118,726 B2
(45) Date of Patent: Nov. 6, 2018

(54) BLANK AND METHODS OF CONSTRUCTING A VENTILATED CONTAINER FROM THE BLANK

(71) Applicant: WestRock Shared Services, LLC, Norcross, GA (US)

(72) Inventors: Jeffrey Scott James, Elmhurst, IL (US); Kenneth John Shanton, West Chicago, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 15/255,483

(22) Filed: Sep. 2, 2016

(65) Prior Publication Data

US 2017/0066552 A1 Mar. 9, 2017

Related U.S. Application Data

(60) Provisional application No. 62/214,035, filed on Sep. 3, 2015.

(51) Int. Cl.

| | |
|---|---|
| ***B65D 5/42*** | (2006.01) |
| ***B65D 5/66*** | (2006.01) |
| ***B31B 3/26*** | (2006.01) |
| ***B65D 5/02*** | (2006.01) |

(52) U.S. Cl.

CPC ..... *B65D 5/4295* (2013.01); *B31B 3/26* (2013.01); *B65D 5/6664* (2013.01); *B31B 2203/10* (2013.01); *B65D 2585/366* (2013.01)

(58) Field of Classification Search

CPC ..... B65D 5/4295; B65D 5/02; B65D 5/4266; B65D 5/66; B65D 2585/366; B65D 2205/02; B31B 3/26; B31B 2203/10

USPC ..... 229/120, 902, 904, 906, 903

See application file for complete search history.

(56) References Cited

U.S. PATENT DOCUMENTS

| | | | | |
|---|---|---|---|---|
| 2,973,858 | A | 3/1961 | Laneve | |
| 3,462,065 | A | 8/1969 | Norman | |
| 3,512,697 | A | 5/1970 | Robinson | |
| 3,923,234 | A | 12/1975 | Lund | |
| 4,476,989 | A | 10/1984 | Larsen | |
| 4,747,485 | A | 5/1988 | Chaussadas | |
| 4,765,534 | A | 8/1988 | Zion et al. | |
| 4,809,908 | A | 3/1989 | Keefe et al. | |
| 4,919,326 | A | 4/1990 | Deiger | |
| 4,957,237 | A * | 9/1990 | Madonna | B65D 5/48018 229/120 |
| 4,984,734 | A | 1/1991 | Zion et al. | |
| 4,993,625 | A | 2/1991 | Stease et al. | |
| 5,000,374 | A | 3/1991 | Deiger | |
| 5,002,221 | A * | 3/1991 | Ragan | B65D 5/48024 229/120 |
| 5,056,710 | A | 10/1991 | Ritter | |
| 5,071,062 | A | 12/1991 | Bradley et al. | |
| 5,110,039 | A | 5/1992 | Philips | |
| 5,125,566 | A | 6/1992 | Deiger | |
| 5,211,329 | A | 5/1993 | Patton | |
| 5,263,634 | A | 11/1993 | Korine | |
| 5,358,173 | A | 10/1994 | Mertz | |

(Continued)

*Primary Examiner* — Christopher Demeree
(74) *Attorney, Agent, or Firm* — WestRock IP Legal

(57) ABSTRACT

A blank of foldable sheet material for forming a container is provided. The blank includes a bottom panel, a top panel, and a set of vent panels configured to form at least one venting assembly positioned on the top panel of the container.

24 Claims, 10 Drawing Sheets

(56) References Cited

U.S. PATENT DOCUMENTS 5,368,225 A 11/1994 Ritter
5,381,949 A 1/1995 Correll
5,402,929 A 4/1995 Ritter et al.
5,452,845 A 9/1995 Ritter
5,476,216 A 12/1995 Robertella et al.
5,535,940 A 7/1996 Olds
5,553,771 A 9/1996 Correll
5,560,539 A 10/1996 Baxter
5,586,716 A 12/1996 Correll
5,595,339 A 1/1997 Correll
5,702,054 A 12/1997 Philips et al.
5,713,509 A 2/1998 Correll
5,752,651 A 5/1998 Correll
5,799,864 A 9/1998 Mertz
5,806,755 A 9/1998 Correll
5,833,130 A 11/1998 Correll
5,881,948 A 3/1999 Correll
5,918,797 A 7/1999 Correll
5,950,912 A * 9/1999 Economopoulos .. B65D 5/5021 229/120.32
5,961,035 A 10/1999 Correll
6,016,951 A 1/2000 Correll
6,065,669 A 5/2000 Correll
6,092,715 A 7/2000 Correll
6,109,512 A 8/2000 Morrison
6,196,448 B1 3/2001 Correll
6,206,277 B1 3/2001 Correll
6,223,978 B1 5/2001 Drager
6,290,122 B1 9/2001 Correll
6,547,125 B2 4/2003 Correll
6,568,586 B1 5/2003 Vanesley et al.
6,685,085 B2 * 2/2004 Hanna ..... B65D 5/2057 229/102
6,748,722 B2 6/2004 Correll
6,749,106 B2 6/2004 Keefe et al.
6,922,976 B2 8/2005 Correll
8,025,207 B1 9/2011 Correll
D649,040 S 11/2011 Sanders
8,627,998 B2 1/2014 Martinez
8,690,043 B2 4/2014 Holch et al.
9,359,102 B2 6/2016 Martinez
9,415,895 B2 8/2016 James et al.
2001/0000561 A1 5/2001 Correll
2003/0015578 A1 1/2003 Keefe et al.
2003/0047593 A1 3/2003 Correll
2003/0121961 A1 7/2003 Pilgrim et al.
2004/0222276 A1 11/2004 Correll
2004/0222277 A1 11/2004 Correll
2004/0222278 A1 11/2004 Correll
2005/0011939 A1 1/2005 Angelopoulos et al.
2005/0103832 A1 5/2005 Correll
2006/0208046 A1 9/2006 Dennen et al.
2007/0199981 A1 8/2007 Oliveira
2010/0108750 A1 5/2010 Coleman
2011/0253772 A1 10/2011 Holch et al.
2016/0297563 A1 10/2016 James et al.
2017/0066552 A1 * 3/2017 James ..... B65D 5/4295

* cited by examiner

BLANK AND METHODS OF CONSTRUCTING A VENTILATED CONTAINER FROM THE BLANK

REFERENCE TO RELATED APPLICATION

This application claims the benefit of priority under 35 U.S.C. § 119(e) of U.S. provisional application Ser. No. 62/214,035 filed on Sep. 3, 2015 which is hereby incorporated by reference in its entirety.

BACKGROUND

The field of the disclosure relates generally to a container formed from a sheet of material, and more particularly to a container that includes at least one venting assembly having an upper and lower vent panel that extends along at least a portion of at least one edge of a top panel of the container.

It is well known in the food industry, including the pizza industry, to provide a food product to a consumer that is packaged in film, foil, paperwrap, a box, or a container. Such containers provide a convenient package to carry the food product from the producer of the food product to a table or other location for consumption by the consumer of the food product. However, if the container is sealed and unventilated and the food product contained within the container is hot, moisture captured within the container may make the drier parts of the food product soggy. Conversely, if the container is too ventilated, there will be excessive heat loss during product transfer. It is also convenient to place multiple containers in a heated bag so a customer and/or delivery person is able to carry those containers from the restaurant for consumption elsewhere. At least some of these containers may be time-consuming to form. Moreover, at least some such known containers do not include easily formed features that facilitate securing a lid to a base of the container when the container is closed.

BRIEF DESCRIPTION

In one aspect, a blank of foldable sheet material for forming a container is provided. The blank includes a top portion including a top panel. The top panel includes a front edge, a rear edge, a first side edge, and a second side edge. The blank further includes at least one venting assembly including a first vent panel and a second vent panel extending from the first vent panel. The first and second vent panels have at least partially free side edges. The partially free side edges at least partially define an opening at each end of the venting assembly. The at least one venting assembly is positioned along one or more of the front edge, the rear edge, the first side edge, and the second side edge.

In another aspect, a container formed from a blank of foldable sheet material is provided. The container includes a top portion including a top panel. The top panel includes a front edge, rear edge, a first side edge, and a second side edge. The container further includes at least one venting assembly including a first vent panel and a second vent panel hingedly connected to the first vent panel. The first and second vent panels have at least partially free side edges. The partially free side edges at least partially defining an opening at each end of the venting assembly. The at least one venting assembly is positioned along one or more of the front edge, the rear edge, the first side edge, and the second side edge.

In another aspect, a method of constructing a container from a blank of sheet material is provided. The method includes rotating two opposing bottom side panels of the blank about a bottom panel toward an interior surface of the blank to form a base. The method also includes rotating two opposing top side panels of the blank about a top panel toward an interior surface of the blank to form a lid. The method further includes rotating the lid toward the base such that a first vent panel and a second vent panel form openings at side edges of the vent panels.

DETAILED DESCRIPTION

Figure 1:
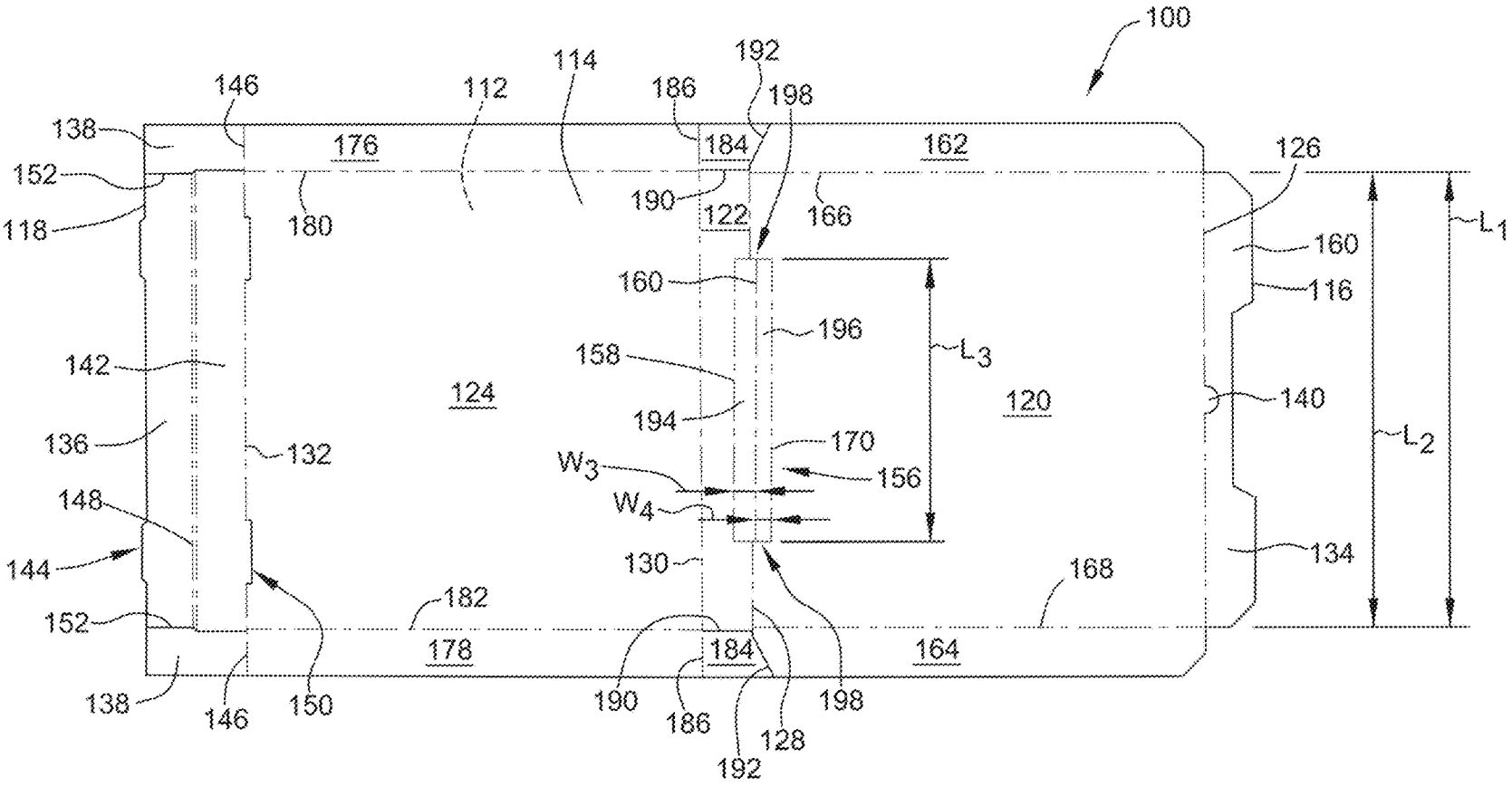
FIG. 1 is a top plan view of a blank of sheet material for constructing a container according to a first embodiment of the present disclosure.

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present disclosure provides a stackable, collapsible container that includes a top panel and at least one venting assembly located along at least a portion of at least one edge of the top panel. The at least one venting assembly provides enhanced ventilation for a food product contained within the container. The enhanced ventilated container is constructed from a blank of sheet material. The blank is formed by a machine that imparts fold lines, cut lines, and other lines of weakness to the blank. In one embodiment, the ventilated container is fabricated from a paperboard material. The ventilated container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In the example embodiment, the ventilated container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclee, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Examples of at least some useful benefits of the ventilated container described herein include the at least one vent (or venting assembly) of the container serving to release steam generated by a heated food product contained within the container to prevent the food product from becoming soggy and undesirable, while retaining heat to prevent the food product from becoming cold too quickly. As described herein, testing of the enhanced ventilated container with pizza contained in the ventilated container showed that the ventilated container improved heat retention and moisture control, resulting in a more user desirable pizza for a longer period of time (e.g., from a moisture standpoint and heat retention standpoint) as compared to other containers containing similar pizza. For example, in at least one test of the ventilated container, a heated pizza contained within the enhanced ventilated container measured temperatures of 30% to 67% hotter than a similar heated pizza contained within a non-ventilated container at about 33 minutes of elapsed time.

In addition, the at least one venting assembly is also configured to provide a better gripping surface such that a consumer is better able to hold the ventilated container when transporting it. The ventilated container may also include at least one tab extending through and below a bottom edge of the bottom panel. The at least one tab is configured to contact a top panel of another ventilated container located underneath the first ventilated container to improve stability and provide a more secure structure for stacking and transporting containers. This allows for multiple ventilated containers to be stacked on one another without making the stack unstable and without crushing the venting assemblies. Additionally, the at least one venting assembly together with the least one tab provides spacing between stacked ventilated containers, further improving heat retention within the ventilated container when compared to other stacked containers without spacing. Furthermore, in one embodiment, the at least one venting assembly includes partially free side edges that angle outwardly to an apex in order to increase structural stability, enabling the at least one venting assembly to support greater weight when containers are stacked and providing improved airflow.

Figure 2:
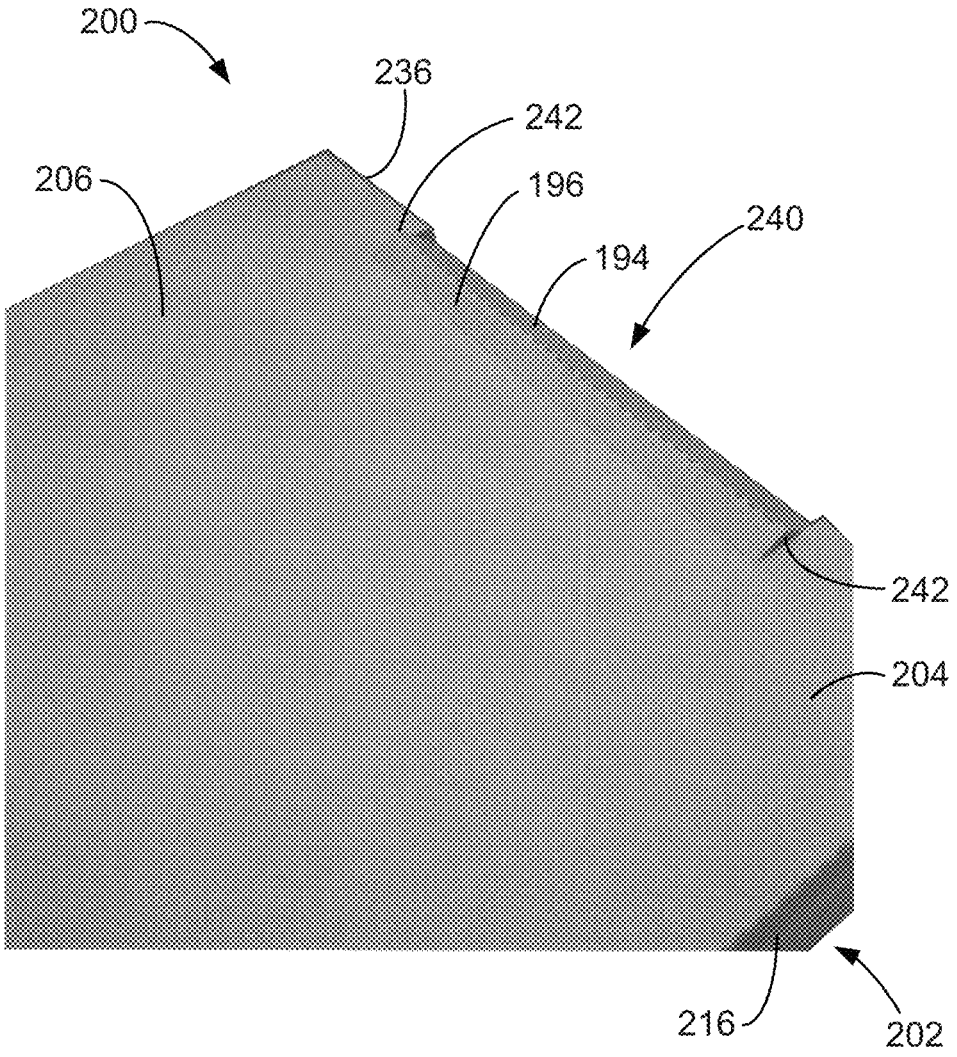
FIG. 2 is a perspective view of a partial container formed from the blank shown in FIG. 1.

Referring now to the drawings, and more specifically to FIGS. 1 and 2, although as described above a container may have any suitable size, shape, and/or configuration, FIGS. 1 and 2 illustrate the construction or formation of a first embodiment of the ventilated container. Specifically, FIG. 1 is a top plan view of a first example embodiment of a blank 100 of sheet material. FIG. 2 is a perspective view of a first example embodiment of a container 200 formed from blank 100 shown in FIG. 1.

Referring to FIG. 1, blank 100 has a first or interior surface 112 and an opposing second or exterior surface 114. Further, blank 100 defines a leading edge 116 and a trailing edge 118. Blank 100 includes, from leading edge 116 to trailing edge 118, a front tuck flap 134, a top panel 120, a back panel 122, a bottom panel 124, a first front panel 142, and a second front panel 136, coupled together along preformed, generally parallel, fold lines 126, 128, 130, 132, and 148 respectively. Blank 100 further includes a venting assembly, defined as vent 156 (also referred to as a venting assembly), consisting of an upper vent panel 196 and a lower vent panel 194, located on a portion of top panel 120 and back panel 122 along fold line 128. Fold lines and/or hinge lines as described herein may include any suitable line of weakening and/or line of separation known to those skilled in the art and guided by the teachings herein provided.

More specifically, top panel 120 extends from front tuck flap 134 along fold line 126, back panel 122 extends from top panel 120 along fold line 128, bottom panel 124 extends from back panel 122 along fold line 130, first front panel 142 extends from bottom panel 124 along fold line 132, and second front panel 136 extends from first front panel 142 along fold line 148. Side flaps 138 exist on each side of front panel 142 and 136, with each side flap 138 separated from front panel 142 and 136 by a cut line 152.

In the example embodiment, front tuck flap 134 has a length L1 that is equal to or less than a length L2 of top panel 120. Front tuck flap 134 and fold line 126 cooperate to form a front edge of top panel 120, and fold line 128 defines a back edge of top panel 120.

Top panel 120 includes a first top side panel 162 and a second top side panel 164 extending therefrom along respective opposing fold lines 166 and 168. More specifically, first top side panel 162 extends from top panel 120 along fold line 166, and second top side panel 164 extends from top panel 120 along fold line 168. Fold lines 166 and 168 define side edges of top panel 120. Additionally, in the example embodiment, a finger tab 140 is located in a center of a front edge defined by fold line 126.

In the example embodiment, top panel 120 further includes vent 156 located along at least a portion of fold line 128. Vent 156 includes a lower vent panel 194 and an upper vent panel 196 extending therefrom along respective fold lines 158, 160, and 170. Fold lines 158 and 170 define edges of vent 156. More specifically, lower vent panel 194 extends from back panel 122 along fold line 158, upper vent panel 196 extends from lower vent panel 194 along fold line 160, and top panel 120 extends from upper vent panel 196 along fold line 170. Fold line 160 is offset from fold line 128, such that fold line 160 is closer to a center of top panel 120. Each end of vent 156 includes a cut line 198 made through top panel 120 and back panel 122. In the example embodiment, lower vent panel 194 has a width W3 that is greater than a width W4 of upper vent panel 196. Furthermore, vent 156 has a length L3 that is one-thirds to two-thirds the length L2 of top panel 120.

Bottom panel 124 has a first bottom side panel 176 and a second bottom side panel 178 extending therefrom along respective opposing fold lines 180 and 182. More specifically, first bottom side panel 176 extends from bottom panel 124 along fold line 180, and second bottom side panel 178 extends from bottom panel 124 along fold line 182. Fold lines 180 and 182 define side edges of bottom panel 124. Fold line 132 defines a front edge of bottom panel 124, and fold line 130 defines a back edge of bottom panel 124. Side flaps 138 further extend from first bottom side panel 176 and second bottom side panel 178 along respective opposing fold line 146. Furthermore, each bottom side panel 176 and 178 includes a back tab 184 extending from a respective back edge 186 of bottom side panel 176 or 178. Each back edge 186 is defined by a fold line. Each back tab 184 is separated from back panel 122 by a cut line 190, and further separated from an adjacent one of top side panels 162 and 164 by a cut line 192. In an alternative embodiment (not shown), each back tab 184 extends from one of top side panels 162 and 164 such that a fold line couples back tab 184 to top side panel 162 or 164, and a cut line separates each back tab 184 from bottom side panel 176 or 178.

With reference to FIGS. 1 and 2, to construct container 200 from blank 100, a base 202 of container 200 and a lid 206 of container 200 are formed. Bottom panel 124 forms a bottom wall of container 200. To form base 202, bottom side panels 176 and 178 are rotated about respective fold lines 180 and 182 toward interior surface 112 along with side flaps 138, which are rotated into position concurrently with side panels 176 and 178 in one motion. Side flaps 138 are rotated about fold lines 146 toward interior surface 112. After rotation, side flaps 138 are in line with fold line 132 and are substantially perpendicular to bottom side panels 176 and 178. After rotation, bottom side panels 176 and 178 are substantially perpendicular to bottom panel 124 and bottom edges of side flaps 138 contact fold line 132.

First front panel 142 and second front panel 136, which are a same approximate width and length, are rotated interiorly along respective fold lines 132 and 148, causing second front panel 136 to be adjacent to first front panel 142 (in a face-to-face relationship), with side flaps 138 located in between first front panel 142 and second front panel 136. First front panel 142 forms an exterior of front wall (not shown) and second front panel 136 forms an interior portion of front wall (not shown).

In the example embodiment, first front panel 142 includes tabs 150 along fold line 132 directed towards top panel 124. Tabs 150 include at least partially free edges between top panel 124 and first front panel 142. Second front panel 136 includes tabs 144 along trailing edge 118 directed away from top panel 124. Tabs 150 and 144 have a same approximate width and length and are located opposite to each other. When first front panel 142 and second front panel 136 are rotated interiorly along respective fold lines 132 and 148, tabs 144 insert into a slot opening created when tabs 150 are rotated outwardly, such that tabs 144 and 150 extend downwardly past a bottom edge of front panels 142 and 136 when the container is constructed. Tabs 144 and 150 extend below bottom panel 124. In one embodiment, tabs 144 extend less than or further than tabs 150.

Bottom side panels 176 and 178 cooperate with front panels 136 and 142 to define a cavity of base 202. Bottom side panels 176 and 178 are configured to form a portion of respective first side wall 216 and second side walls (not shown), and front panels 136 and 142 are configured to form a portion of a front wall (not shown). After rotation, bottom side panels 176 and 178 and front panel 142 are substantially perpendicular to bottom panel 124.

Back tabs 184 are rotated about respective fold lines 186 toward interior surface 112 to form a portion of a back wall 236 that at least partially defines cavity. It should be understood that back tabs 184 may be rotated into position before or after side flaps 138 are rotated toward interior surface 112.

To construct lid 206 of container 200, top side panels 162 and 164 are rotated about respective fold lines 166 and 168 toward interior surface 112, and front tuck flap 134 is rotated about fold line 126 toward interior surface 112, such that top side panels 162 and 164 and front tuck flap 134 are perpendicular to top panel 120. It should be understood that lid 206 may be formed before base 202 is formed.

To close container 200, lid 206 is rotated toward base 202 along fold lines 128 and 130. As lid 206 is rotated toward base 202, back panel 122 is rotated about fold line 130 to form back wall 236. More specifically, back wall 236 is formed when back panel 122 is adjacent to back tabs 184. Additionally, when container 200 is closed, top panel 120 forms a top wall 204 of container 200, and front tuck flap 134 contacts second front panel 136 to form, along with first front panel 142, front wall (not shown) of container 200 and at least partially defines a releasably secure closure of lid 206 and base 202.

In the example embodiment when container 200 is in a closed position, a venting assembly 240 is formed on top wall 204 along at least a portion of fold line 128. In the example embodiment, venting assembly 240 is a raised triangular cross-sectional shape. In the example embodiment, vent 240 is similar to vent 156 shown in FIG. 1. More specifically, upper vent panel 196 and lower vent panel 194 are configured to form vent 240 on top wall 204 along at least a portion of fold line 128, thereby creating openings 242 into cavity at cut lines 198 on each end of vent 240. Openings 242 are in air flow communication with the cavity and a surrounding area outside of container 200 (i.e., ambient environment). As lid 206 is rotated toward base 202 along fold lines 128 and 130, lower vent panel 194, which in the example embodiment has a greater width than upper vent panel 196, rotates along fold line 158 into an upwards slope position, upper vent panel 196 rotates along fold lines 160 and 170 into a downwards slope position, creating triangular-shaped vent 240, with fold line 160 being an apex of triangular-shape vent 240.

In certain embodiments, top side panels 162 and 164 are so received in a friction fit, defining a releasably secure closure of lid 206 and base 202. More specifically, when container 200 is closed, exterior of top side panel 162 forms a friction fit with interior of bottom side panel 176 to form first side wall 216 of container 200, exterior of top side panel 164 forms a friction fit with interior of bottom side panel 178 to form second side wall (not shown) of container 200, and exterior of front tuck flap 134 forms a friction fit with second front panel 136 to, along with first front panel 142, form front wall (not shown) of container 200. More specifically, exterior surface of each top side panel 162 and 164 and front tuck flap 134 contact interior surface of each respective bottom side panel 176 and 178 and second front panel 136. In alternative embodiments, one or more of top side panel 162 and 164 and front tuck flap 134 are so received in a clearance fit and/or a non-contact fit.

Prior to closing container 200, a product, such as a food product, may be placed within base 202. As such, when lid 206 engages base 202, the product is secured within the cavity by lid 206 and base 202.

As such, the following steps are performed to form container 200 from blank 100: (1) rotate side flaps 138 about respective fold lines toward interior surface 112; (2) rotate bottom side panels 176 and 178 about respective fold lines toward interior surface 112 to form a portion of side walls; (3) rotate first front panel 142 and second front panel 136 about respective fold lines towards interior surface 112, such that, after the rotating, second front panel 136 contacts first front panel 142, with side flaps 138 located in between first front panel 142 and second front panel 136, tabs 144 on second front panel 136 are inserted into partially free edges of tabs 150, and front panels 136 and 142 are substantially perpendicular to bottom wall 203, to form a portion of front wall (not shown); (4) rotate front tuck flap 134 and top side panels 162 and 164 toward interior surface 112 to form lid 206; and (5) rotate lid 206 toward base 202 to form first side wall 216, second side wall (not shown) and front wall (not shown). In an alternative embodiment, step (4) is performed before steps (1), (2), and (3).

Figure 3:
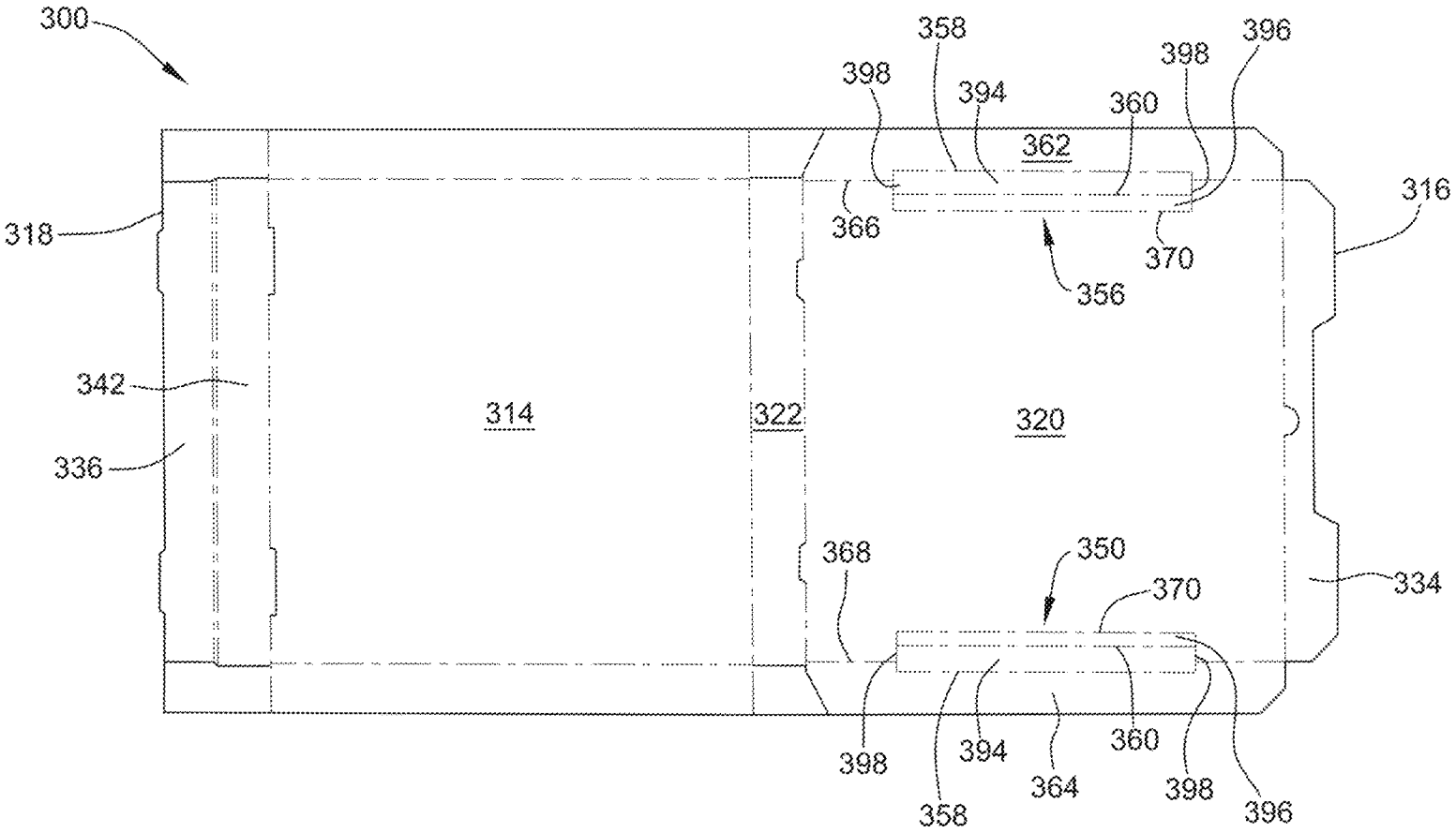
FIG. 3 is a top plan view of a blank of sheet material for constructing a container according to a second embodiment of the present disclosure.
Figure 4:
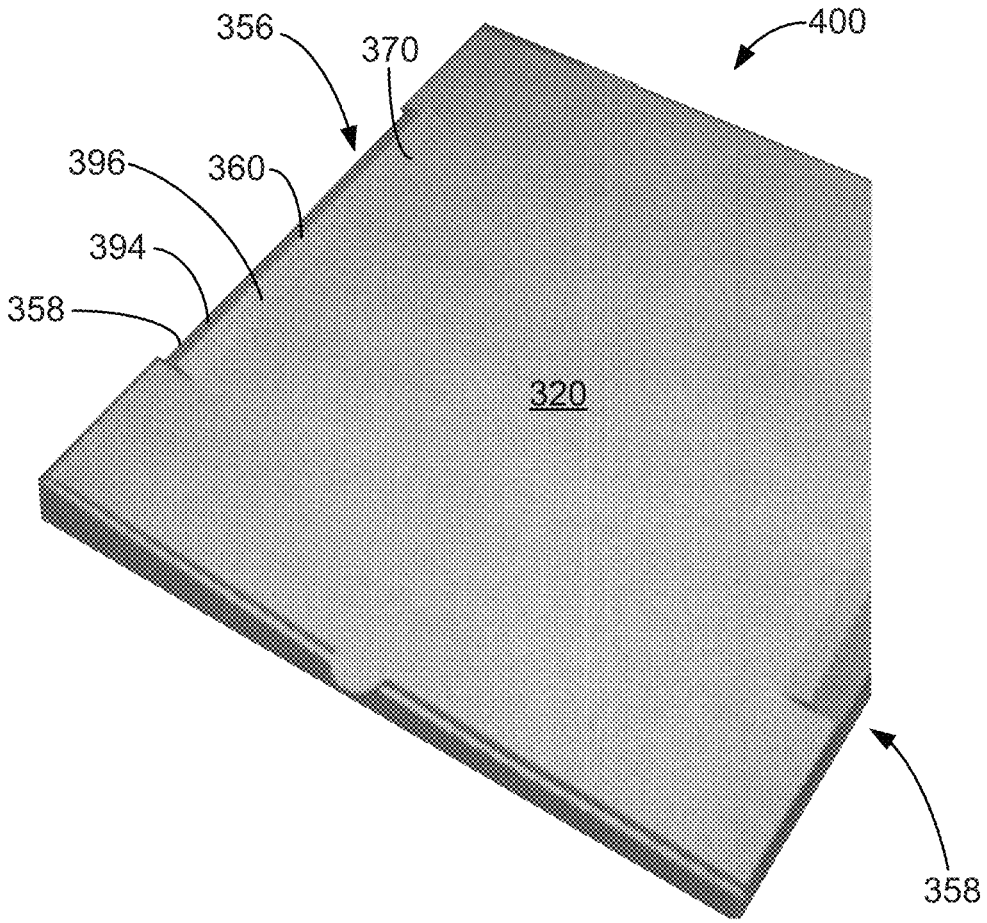
FIG. 4 is a perspective view of a partial container formed from the blank shown in FIG. 3.

FIG. 3 is a top plan view of a second example embodiment of a blank 300 of sheet material. Similar to blank 100, blank 300 includes, from a leading edge 316 to a trailing edge 318, a front tuck flap 334, a top panel 320, a back panel 322, a bottom panel 314, a first front panel 342, and a second front panel 336. FIG. 4 is a perspective view of a second example embodiment of a container 400 formed from blank 300 shown in FIG. 3. Blank 300 and container 400 are substantially similar to blank 100 and container 200 shown in FIGS. 1 and 2, except as otherwise noted. In particular, blank 300 and container 400 include vents 356 and 350 (or venting assemblies) on top panel 320 along at least a portion of respective fold lines 366 and 368. Vent 240 is not included.

Vent 356, located along at least a portion of fold line 366, includes a lower vent panel 394 and an upper vent panel 396. Lower vent panel 394 extends from top side panel 362 along fold line 358. Upper vent panel 396 extends from lower vent panel 394 along fold line 360. Top panel 320 extends from upper vent panel 396 along fold line 370. Cut lines 398 through top panel 320 and top side panel 362 are located at each end of vent panel 394 and 396. In one embodiment, lower vent panel 394 has a greater width than upper vent panel 396.

Vent 350, located along at least a portion of fold line 368, includes a lower vent panel 394 and an upper vent panel 396. Lower vent panel 394 extends from top side panel 364 along fold line 358. Upper vent panel 396 extends from lower vent panel 394 along fold line 360. Top panel 320 extends from upper vent panel 396 along fold line 370. Cut lines 398 through top panel 320 and top side panel 364 are located at each end of vent panel 394 and 396. In one embodiment, lower vent panel 394 has a greater width than upper vent panel 396.

Figure 5:
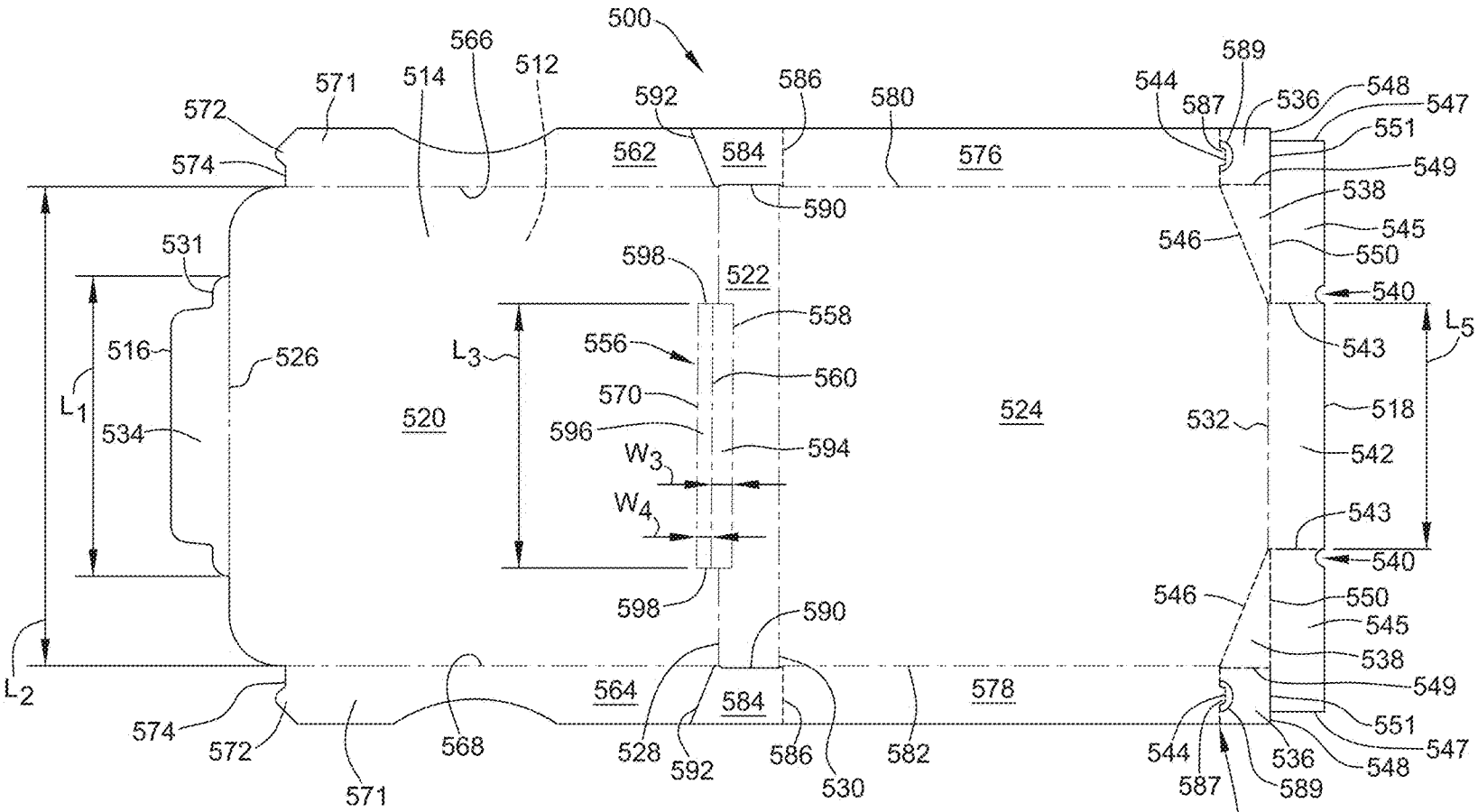
FIG. 5 is a top plan view of a blank of sheet material for constructing a container according to a third embodiment of the present disclosure.
Figure 6:
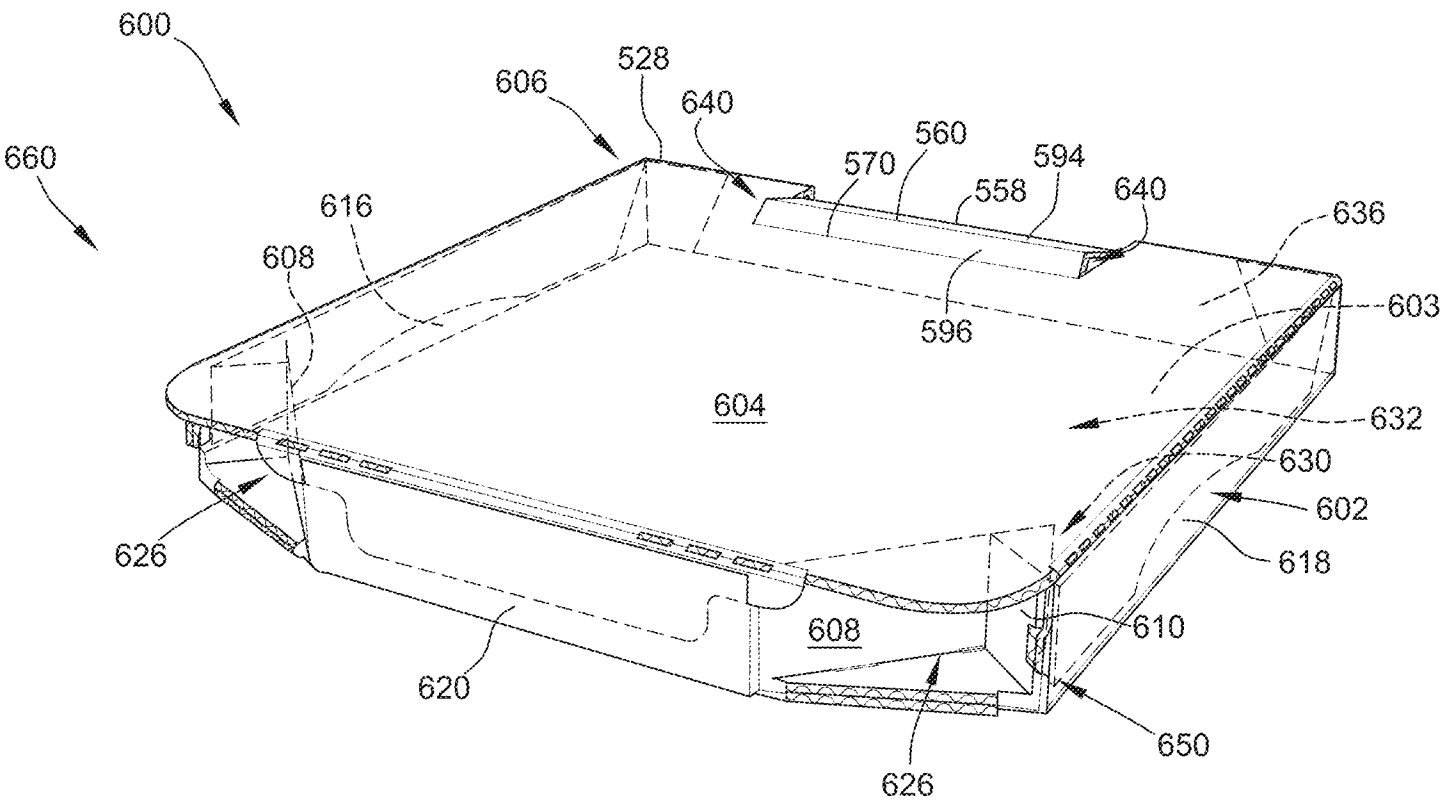
FIG. 6 is a perspective view of a container formed from the blank shown in FIG. 5.

FIG. 5 is a top plan view of a third example embodiment of a blank 500 of sheet material. Similar to blank 100, blank 500 includes, from a leading edge 516 to a trailing edge 518, a front tuck flap 534, a top panel 520, a back panel 522, and a bottom panel 524. FIG. 6 is a perspective view of a third example embodiment of a container 600 formed from blank 500 shown in FIG. 5. Blank 500 and container 600 are substantially similar to blank 100 and container 200 shown in FIGS. 1 and 2, except as otherwise noted. In particular, blank 500 and container 600 include minor and major diagonal panels.

Referring to FIG. 5, blank 500 has a first or interior surface 512 and an opposing second or exterior surface 514. Further, blank 500 defines a leading edge 516 and a trailing edge 518. Blank 500 includes, from leading edge 516 to trailing edge 518, a front tuck flap 534, a top panel 520, a back panel 522, a bottom panel 524, and a front panel 542, coupled together along preformed, generally parallel, fold lines 526, 528, 530, and 532, respectively. Fold lines and/or hinge lines as described herein may include any suitable line of weakening and/or line of separation known to those skilled in the art and guided by the teachings herein provided.

More specifically, top panel 520 extends from front tuck flap 534 along fold line 526, back panel 522 extends from top panel 520 along fold line 528, bottom panel 524 extends from back panel 522 along fold line 530, and front panel 542 extends from bottom panel 524 along fold line 532. In the example embodiment, front tuck flap 534 includes a pair of offset edges 531 disposed at opposite ends of front tuck flap 534. More specifically, offset edges 531 are offset from leading edge 516 of blank 500. In alternative embodiments, front tuck flap 534 does not include offset edges 531.

In the example embodiment, front tuck flap 534 has a length L1 that is less than a length L2 of top panel 520, such that a pair of free edges 560 of top panel 520 are defined on opposing sides of, and substantially co-linear with, fold line 526. Free edges 560 and fold line 526 cooperate to form a front edge of top panel 520, and fold line 528 defines a back edge of top panel 520. In alternative embodiments, length L1 is equal to or greater than length L2, such that top panel 520 does not include free edges 560.

Top panel 520 includes a first top side panel 562 and a second top side panel 564 extending therefrom along respective opposing fold lines 566 and 568. More specifically, first top side panel 562 extends from top panel 520 along fold line 566, and second top side panel 564 extends from top panel 520 along fold line 568. Fold lines 566 and 568 define side edges of top panel 520. Each of first top side panel 562 and second top side panel 564 includes a front edge 574 that is configured to engage one of minor diagonal panels 536 to at least partially define the second releasably secure closure of container 600 in a closed position 660. For example, in the illustrated embodiment, each of first top side panel 562 and second top side panel 564 includes a front portion 571 proximate front edge 574, and a locking tab 572 that extends from front edge 574. More specifically, in the example embodiment, each locking tab 572 is configured to be received in a locking aperture 650 defined in a minor diagonal wall 610 of container 600 to at least partially define the second releasably secure closure of container 600 in closed position 660, as shown in FIG. 6.

In the example embodiment, top panel 520 includes a pair of rounded front corner edges 570. Each rounded front corner edge 570 extends between a free edge 560 and a respective side edge of top panel 520. Alternatively, top panel 520 does not include rounded front corner edges 570.

In the example embodiment, top panel 520 further includes vent (or venting assembly) 556 located along at least a portion of fold line 528. Vent 556 includes a lower vent panel 594 and an upper vent panel 596 extending therefrom along respective fold lines 558, 560, and 570. Fold lines 558 and 570 define the edges of vent 556. More specifically, lower vent panel 594 extends from back panel 522 along fold line 558, upper vent panel 596 extends from lower vent panel 594 along fold line 560, and top panel 520 extends from upper vent panel 596 along fold line 570. Each end of vent 556 includes a cut line 598 made through top panel 520 and back panel 522. In the example embodiment, lower vent panel 594 has a width greater than a width of upper vent panel 596, such that lower vent panel 594 has a width W3 that is greater than a width W4 of upper vent panel 596. Furthermore, vent 556 has a length L3 that is between one-thirds to two-thirds the length L2 of top panel 520.

Bottom panel 524 has a first bottom side panel 576 and a second bottom side panel 578 extending therefrom along respective opposing fold lines 580 and 582. More specifically, first bottom side panel 576 extends from bottom panel 524 along fold line 580, and second bottom side panel 578 extends from bottom panel 524 along fold line 582. Fold lines 580 and 582 define side edges of bottom panel 524. Furthermore, each bottom side panel 576 and 578 includes a back tab 584 extending from a respective back edge 586 of bottom side panel 576 or 578. Each back edge 586 is defined by a fold line. Each back tab 584 is separated from back panel 522 by a cut line 590, and further separated from an adjacent one of top side panels 562 and 564 by a cut line 592. In an alternative embodiment (not shown), each back tab 584 extends from one of top side panels 562 and 564 such that a fold line couples back tab 584 to top side panel 562 or 564, and a cut line separates each back tab 584 from bottom side panel 576 or 578.

In the example embodiment, each bottom side panel 576 and 578 also has a minor diagonal panel 536 extending from a respective front edge 588 of the bottom side panel. Each bottom side panel front edge 588 is partially defined by a cut line 587 that defines a slot-forming tab 544 on bottom side panel front edge 588, and further at least partially defined by at least one fold line 589 extending from an end of cut line 587. In the example embodiment, the at least one fold line 589 is a pair of fold lines 589 that extend from opposing edges of cut line 587. Each slot forming tab 544 is configured to form one of locking apertures 650 of container 600, as shown in FIG. 6, when minor diagonal panel 536 is rotated about fold line 589.

Front panel 542 includes a pair of oppositely disposed side edges 543. Each side edge 543 is defined by a fold line. A major diagonal panel 545 extends from each side edge 543. Each major diagonal panel 545 has a length greater than a length of each minor diagonal panel 536, wherein the length of major diagonal panel 545 is measured between a respective fold line 543 and a respective side edge 547 of major diagonal panel 545, and the length of minor diagonal panel 536 is measured between a respective fold line 588 and a front edge 548 of minor diagonal panel 536.

Fold line 532 defines a front edge of bottom panel 524, and fold line 530 defines a back edge of bottom panel 524. In addition, bottom panel 524 includes a pair of oppositely disposed angled edges 546 that extend from opposing ends of fold line 532 to bottom panel side edges 580 and 582, respectively. Each angled edge 546 is defined by a respective fold line. A corner panel 538 extends from each angled edge 546. Moreover, each corner panel 538 is separated from an adjacent minor diagonal panel 536 by a fold line 549, and is separated from an adjacent major diagonal panel 545 by a respective fold line 550. In addition, each minor diagonal panel 536 is separated from an adjacent major diagonal panel 545 by a respective cut line 551.

Front panel 542 is configured to engage front tuck flap 534 to at least partially define a first releasably secure closure of container 600 in closed position 660. For example, in the illustrated embodiment, a notch 540 is defined in trailing edge 518 along each side edge 543 of front panel 542. Each notch 540 is configured to receive at least a portion of front tuck flap 534 to at least partially define the first releasably secure closure of container 600 in closed position 660, as shown in FIG. 6. In alternative embodiments, any suitable number of notches 540 disposed at any suitable location are configured to receive any suitable portion of front tuck flap 534. In the example embodiment, front panel 542 has a length L5 that is less than or equal to length L1 of front tuck flap 534. In alternative embodiments, length L5 is greater than length L1.

With reference to FIGS. 5 and 6, to construct container 600 from blank 500, a base 602 of container 600 and a lid 606 of container 600 are formed. To form base 602, corner panels 538 are rotated about respective fold lines 546 toward interior surface 512 to overlap at least a portion of bottom panel 524. After rotation, corner panels 538 are substantially parallel to bottom panel 524 such that interior surface 512 of each corner panel 538 is adjacent to interior surface 512 of bottom panel 524. Bottom panel 524 and corner panels 538 form a bottom wall 603 of container 600.

When corner panels 538 are rotated toward interior surface 512, major diagonal panels 545, minor diagonal panels 536, and front panel 542 are also rotated about respective fold lines 546, 543, 550, 549, and 532 toward interior surface 512 because of the interconnectivity of each of major diagonal panels 545, minor diagonal panels 536, and front panel 542 with corner panels 538. In addition, bottom side panels 576 and 578 are also rotated about respective fold lines 580 and 582 toward interior surface 512 because of the interconnectivity of bottom side panels 576 and 578 with respective minor diagonal panels 536. As such, major diagonal panels 545, minor diagonal panels 536, bottom side panels 576 and 578, and front panel 542 are rotated into position concurrently with corner panels 538 in one motion. Major diagonal panels 545 form respective major diagonal walls 608, and minor diagonal panels 536 form respective minor diagonal walls 610. Bottom side panels 576 and 578 are configured to form a portion of respective first and second side walls 616 and 618, and front panel 542 is configured to form a portion of a front wall 620. After rotation, bottom side panels 576 and 578, front panel 542, major diagonal walls 608, and minor diagonal walls 610 are substantially perpendicular to bottom wall 606.

In the example embodiment, when minor diagonal panels 536 are rotated, slot-forming tabs 544 separate from minor diagonal panels 536, forming locking apertures 650 in each minor diagonal wall 610 adjacent first and second side walls 616 and 618. Further, when corner panels 538 are rotated into position, front edges 548 of each minor diagonal panel 536 contact an adjacent major diagonal panel 545, and side edges 547 of each major diagonal panel 545 are adjacent to, but spaced from, a respective adjacent bottom side panel 576 and 578. Each minor diagonal wall 610 extends from front edge 588 of the respective bottom side panel 576 and 578 at an acute angle relative to the bottom side panel, and each major diagonal wall 608 extends from one of side edges 543 of front panel 542 at an obtuse angle relative to front panel 542. A recess 626 is defined by each major diagonal wall 608, minor diagonal wall 610, and corner panel 538. Further, each of bottom side panels 576 and 578 cooperates with an adjacent minor diagonal wall 610 and an adjacent major diagonal wall 608 to define a respective chamber 630 within a cavity 632 of base 602. Each chamber 630 is separated from one of recesses 626 by a corresponding minor diagonal wall 610.

Back tabs 584 are rotated about respective fold lines 586 toward interior surface 512 to form a portion of a back wall 636 that at least partially defines cavity 632. It should be understood that back tabs 584 may be rotated into position before or after corner panels 538 are rotated toward interior surface 512.

To construct lid 606 of container 600, top side panels 562 and 564 are rotated about respective fold lines 566 and 568 toward interior surface 512, and front tuck flap 534 is rotated about fold line 526 toward interior surface 512, such that top side panels 562 and 564 and front tuck flap 534 are perpendicular to top panel 520. It should be understood that lid 606 may be formed before base 602 is formed.

To close container 600, lid 606 is rotated toward base 602 along fold lines 528 and 530. As lid 606 is rotated toward base 602, back panel 522 is rotated about fold line 530 to form back wall 636. More specifically, back wall 636 is formed when back panel 522 is adjacent to back tabs 584. Additionally, when container 600 is closed, top panel 520 forms a top wall 604 of container 600, and front tuck flap 534 engages front panel 542 to form front wall 620 of container 600 and at least partially define the first releasably secure closure of lid 606 and base 602. In the example embodiment, each notch 540 receives at least a portion of front tuck flap 534 to at least partially define the first releasably secure closure of lid 606 and base 602. More specifically, each notch 540 receives one of pair of offset edges 531 of front tuck flap 534 to at least partially define the first releasably secure closure of lid 606 and base 602. In alternative embodiment, each notch 540 receives any suitable portion of front tuck flap 534.

In the example embodiment when container 600 is in the closed position, vent 640 is formed on top wall 604 along at least a portion of fold line 528. In the example embodiment, vent 640 has a raised triangular cross-sectional shape. More specifically, upper vent panel 596 and lower vent panel 594 are configured to form vent 640 on top wall 604 along at least a portion of fold line 528, thereby creating an opening into cavity 632 at cut lines 598 on each side of vent 640. As lid 606 is rotated toward base 602 along fold lines 528 and 530, lower vent panel 594, which in the example embodiment has a greater length than upper vent panel 596, rotates along fold line 558 into an upwards slope position, upper vent panel 596 rotates along fold lines 560 and 570 into a downwards slope position, creating triangular-shaped vent 640, with fold line 560 being an apex of triangular-shape vent 640.

In addition, when container 600 is closed, top side panel 562 cooperates with bottom side panel 576 to form first side wall 616 of container 600, and top side panel 564 cooperates with bottom side panel 578 to form second side wall 618 of container 600. More specifically, exterior surface 514 of each top side panel 562 and 564 contacts interior surface 512 of respective bottom side panel 576 and 578, and front portion 571 of each top side panel 562 and 564 is at least partially disposed within one of chambers 630. Moreover, each front edge 574 of top side panels 562 and 564 engages one of minor diagonal panels 536 to at least partially define the second releasably secure closure of container 600 in closed position 660. For example, in the illustrated embodiment, locking tab 572 of each front edge 574 is received in a respective locking aperture 650 of minor diagonal walls 610, at least partially defining the second releasably secure closure of lid 606 and base 602.

Additionally, front portion 571 of top side panel 562 is received between bottom side panel 576 and side edge 547 of adjacent major diagonal panel 545, and front portion 571 of top side panel 564 is received between bottom side panel 578 and side edge 547 of adjacent major diagonal panel 545. In certain embodiments, each front portion 571 is so received in a friction fit, defining a third releasably secure closure of lid 606 and base 602. In alternative embodiments, each front portion 571 is so received in a clearance fit and/or a non-contact fit.

Prior to closing container 600, a product, such as a food product, may be placed within base 602. As such, when lid 606 engages base 602, the product is secured within cavity 632 by lid 606 and base 602.

As such, the following steps are performed to form container 600 from blank 500: (1) rotate corner panels 536 toward bottom panel 524 to form base 602; (2) rotate back tabs 584 toward interior surface 512 to form a portion of back wall 636; (3) rotate front tuck flap 534 and top side panels 562 and 564 toward interior surface 512 to form lid 606; and (4) rotate lid 606 toward base 602 to form side walls 616 and 618 and front wall 620. In an alternative embodiment, steps (1) and (2) are interchanged. In another alternative embodiment, step (3) is performed before steps (1) and (2).

Figure 7:
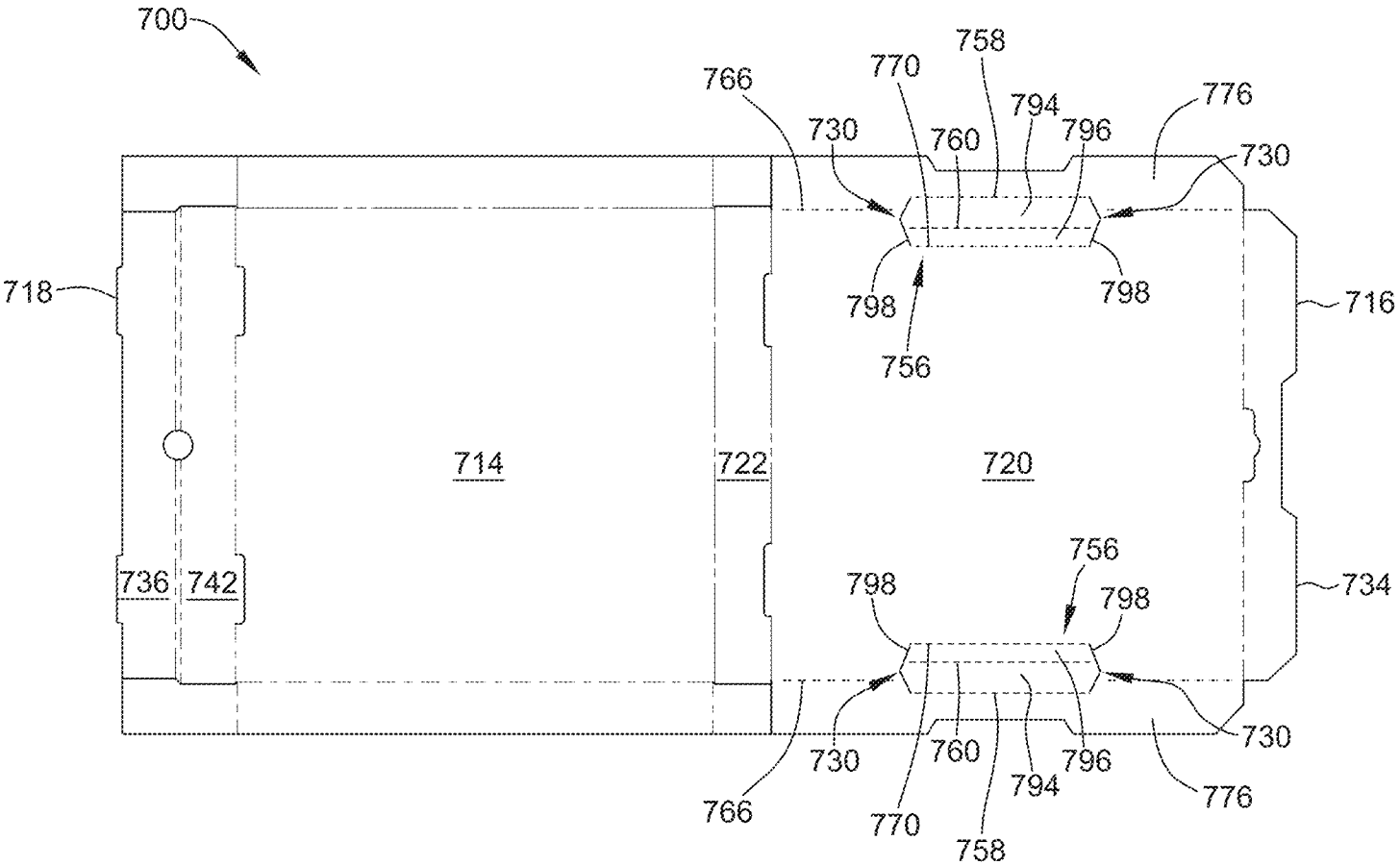
FIG. 7 is a top plan view of a blank of sheet material for constructing a container according to a fourth embodiment of the present disclosure.
Figure 8:
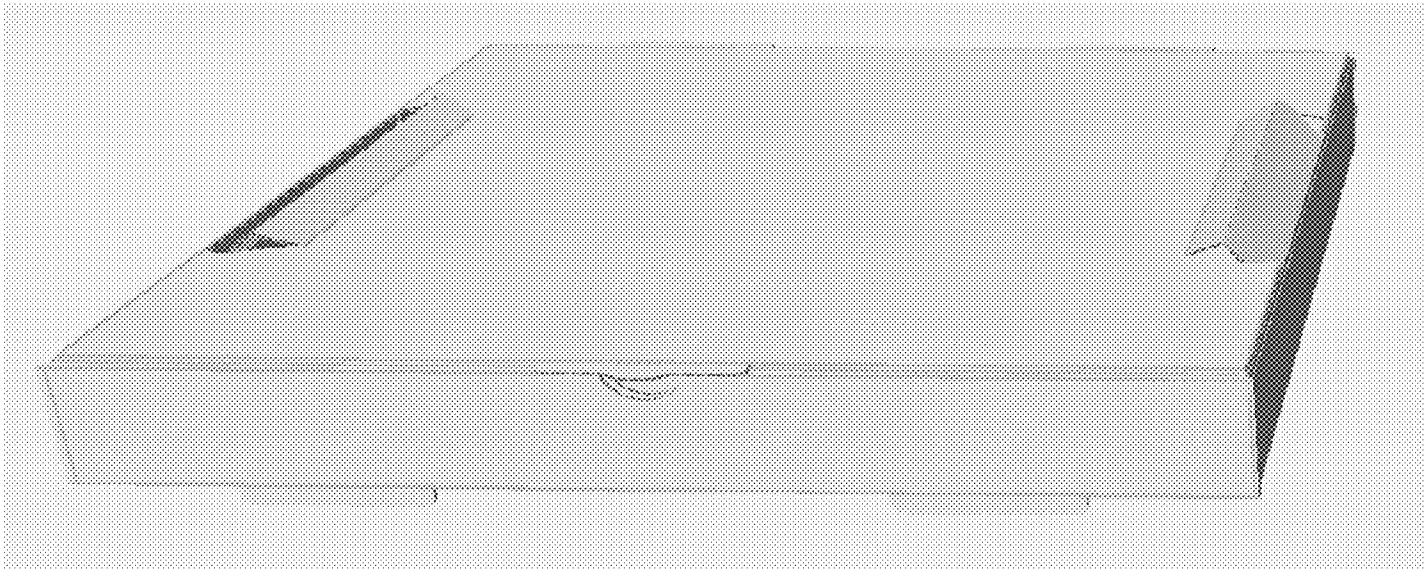
FIG. 8 is a perspective view of a container formed from the blank shown in FIG. 7.

FIG. 7 is a top plan view of a forth example embodiment of a blank 700 of sheet material. Similar to blank 100, blank 700 includes, from a leading edge 716 to a trailing edge 718, a front tuck flap 734, a top panel 720, a back panel 722, a bottom panel 714, a first front panel 742, and a second front panel 736. FIG. 8 is a perspective view of a forth example embodiment of a container 800 formed from blank 700 shown in FIG. 7. Blank 700 and container 800 are substantially similar to blank 100 and container 200 shown in FIGS. 1 and 2, except as otherwise noted. In particular, vents 756 have partially free side edges that angle outwards to an apex.

In the example embodiment, top panel 720 includes vents (or venting assemblies) 756 on top wall 720 along at least a portion of respective fold lines 766. Each vent 756 includes a lower vent panel 794 and an upper vent panel 796 extending therefrom along respective fold lines 758, 760, and 770. More specifically, lower vent panel 794 extends from top side panels 776 along fold line 758, upper vent panel 796 extends from lower vent panel 794 along fold line 760, and top panel 720 extends from upper vent panel 796 along fold line 770. Each end of vent 756 includes an at least partially free side edge 798. In the example embodiment, lower vent panel 794 includes an apex 730 on each of side edges 798 that is spaced a distance from fold line 758 that is approximately a half to two-thirds of the distance between fold line 758 and fold line 760, where side edges 798 extend at an oblique angle from apex 730 and relative to fold line 760. More specifically, the side edges 798 extend at an angle ranging between 30 and 60 degrees relative to fold line 760.

Figure 9:
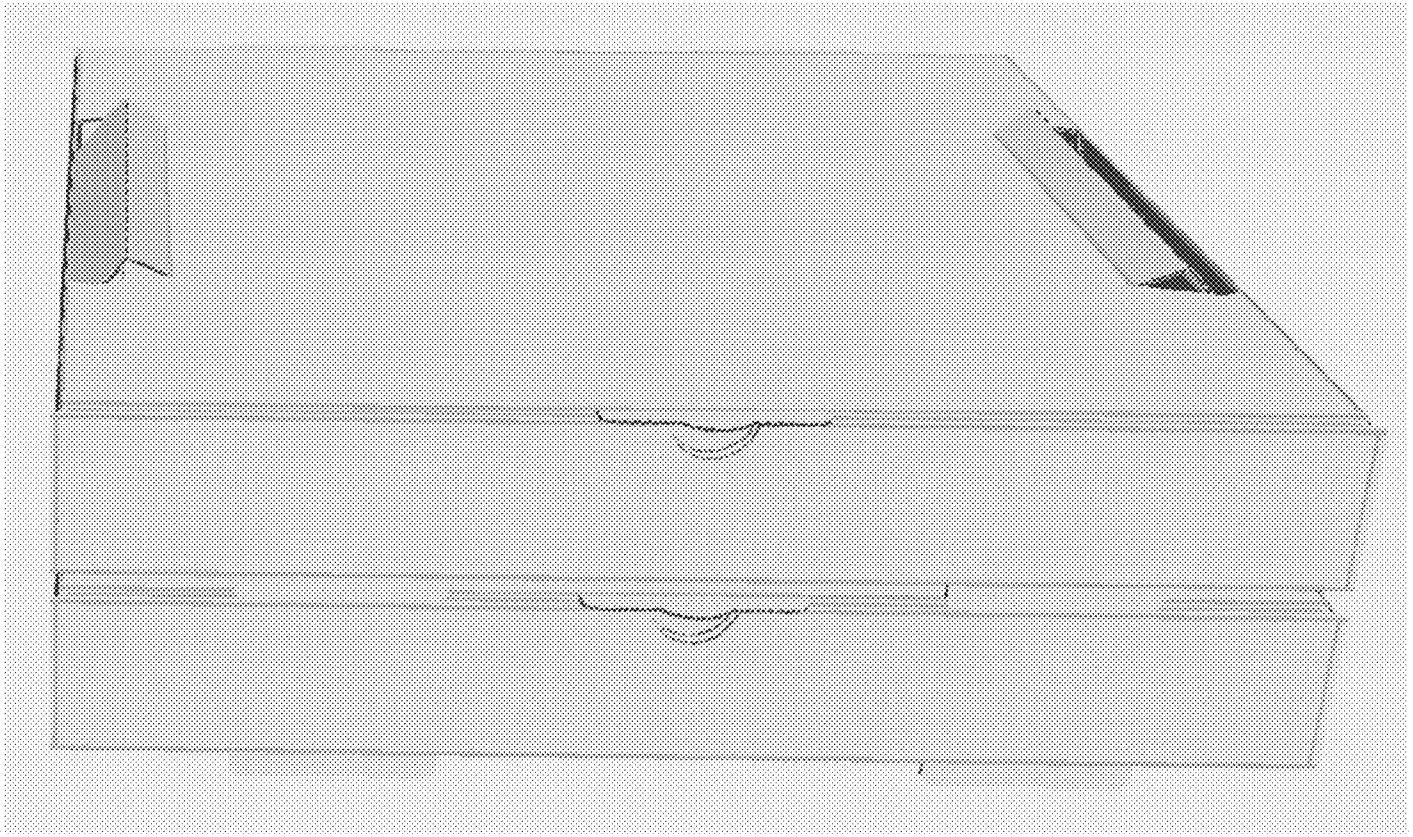
FIG. 9 is a perspective view of two containers, each container formed from the blank shown in FIG. 7, stacked one on top of the other.
Figure 10:
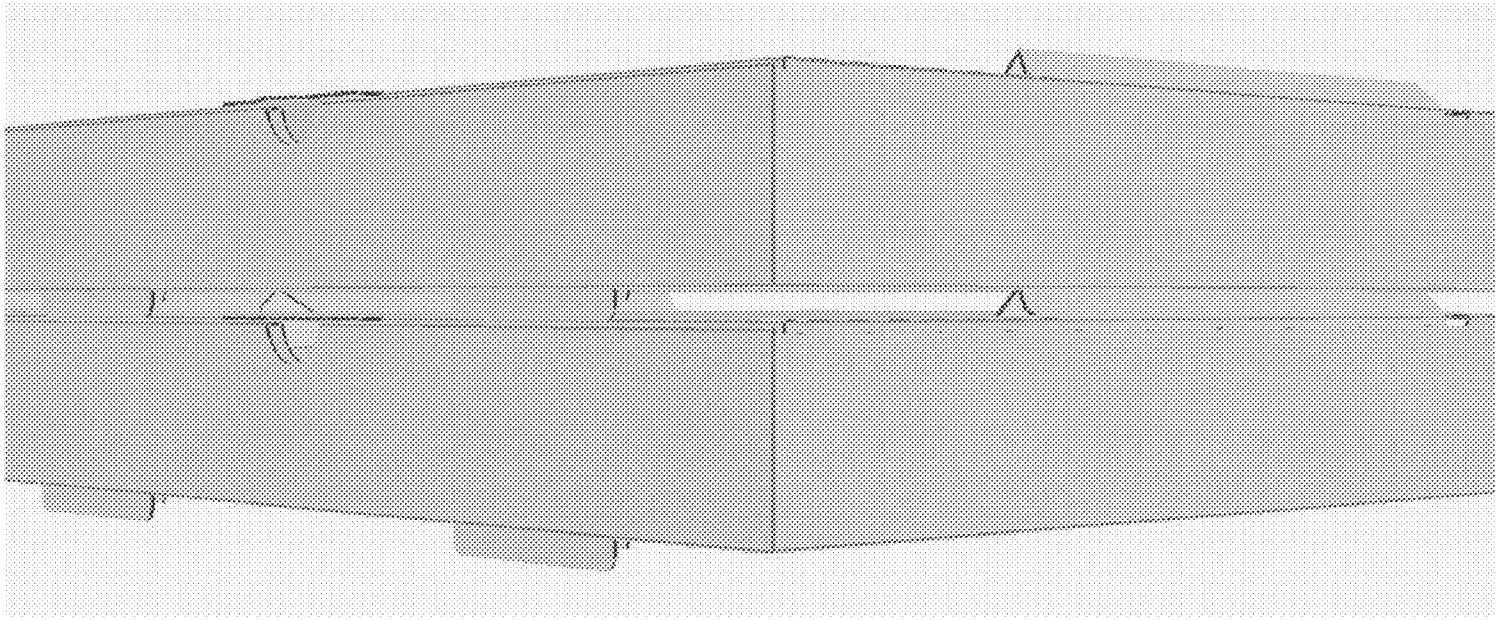
FIG. 10 is a side view of the two containers stacked one on top of the other shown in FIG. 9.

FIG. 8 is a perspective view of a container formed from blank 700 shown in FIG. 7. FIG. 9 is a perspective view of two containers with one stacked on top of another, wherein each of the containers is formed from blank 700 as shown in FIG. 7. FIG. 10 is a side view of the two containers stacked one on top of the other as shown in FIG. 9.

Embodiments of the above-described container are easily constructed from a flexible unitary blank of paperboard. Further, embodiments of the above-described container include an easily formed first releasably secure closure of a lid and a base, at least partially defined by engagement of a front tuck flap on the lid and a front panel of the base, and an easily formed second releasably secure closure of the lid and the base, at least partially defined by engagement of the side panels of the lid with the side panels of the base.

Exemplary embodiments of a container have been described above in detail. The container is not limited to the specific embodiments described herein, but rather, components of the container and/or steps of the method may be utilized independently and separately from other components and/or steps described herein. Further, the described components and/or method steps can also be defined in, or used in combination with, other apparatus and/or methods, and are not limited to practice with only the apparatus and method as described herein.

While the invention has been described in terms of various specific embodiments, those skilled in the art will recognize that the invention can be practiced with modification within the spirit and scope of the claims.

What is claimed is:

1. A blank of foldable sheet material for forming a container, said blank comprising:

a top portion comprising a top panel, wherein the top panel includes a front edge, a rear edge, a first side edge, and a second side edge; and at least one venting assembly comprising a first vent panel and a second vent panel extending from the first vent panel, the first and second vent panels having at least partially free side edges, the partially free side edges at least partially defining an opening at each end of the at least one venting assembly, wherein the at least one venting assembly is positioned along one or more of the front edge, the rear edge, the first side edge, and the second side edge; wherein the first vent panel is a lower vent panel and the second vent panel is an upper vent panel, wherein the upper vent panel is configured to extend above the top panel when the container is formed.

2. A blank in accordance with claim 1, wherein the first vent panel is of equal or greater width than the second vent panel.

3. A blank in accordance with claim 1, wherein each at least partially free side edge is angled outwardly to an apex.

4. A blank in accordance with claim 3, wherein the at least one venting assembly further comprises a fold line extending between the first vent panel and the second vent panel, and the apex is offset from the fold line.

5. A blank in accordance with claim 1, wherein the opening at each end of the at least one venting assembly is configured to enable airflow communication between a cavity of the container and an ambient environment.

6. A blank in accordance with claim 1, wherein the at least one venting assembly comprises a length that is equal to or less than a length of the top panel.

7. A blank in accordance with claim 1, further comprising a front tuck flap extending from a front edge of the top panel.

8. A blank in accordance with claim 7, wherein an exterior surface of the front tuck flap is configured to engage in a friction fit with an interior surface of a front bottom panel when the container is formed.

9. A blank in accordance with claim 1 further comprising a first top side panel and a first bottom side panel, wherein an exterior surface of the first top side panel is configured to engage in a friction fit with an interior surface of the first bottom side panel when the container is formed.

10. A blank in accordance with claim 1, wherein the upper vent panel extends from the lower vent panel to the top panel.

11. A blank in accordance with claim 1 further comprising a bottom panel and one or more front panel tabs, wherein the one or more front panel tabs are configured to extend downwardly below the bottom panel when the container is formed.

12. A blank of foldable sheet material for forming a container, said blank comprising:

a top portion comprising a top panel, wherein the top panel includes a front edge, a rear edge, a first side edge, and a second side edge; and at least one venting assembly comprising a first vent panel and a second vent panel extending from the first vent panel, the first and second vent panels having at least partially free side edges, the partially free side edges at least partially defining an opening at each end of the at least one venting assembly, wherein the at least one venting assembly is positioned along one or more of the front edge, the rear edge, the first side edge, and the second side edge, wherein the at least one venting assembly comprises a length that is approximately one-half of a length of the top panel.

13. A container formed from a blank of foldable sheet material, said container comprising:

a top portion comprising a top panel, wherein the top panel includes a front edge, rear edge, a first side edge, and a second side edge; and at least one venting assembly comprising a first vent panel and a second vent panel hingedly connected to the first vent panel, the first and second vent panels having at least partially free side edges, the partially free side edges at least partially defining an opening at each end of the at least one venting assembly, wherein the at least one venting assembly is positioned along one or more of the front edge, the rear edge, the first side edge, and the second side edge, wherein the first vent panel is a lower vent panel and the second vent panel is an upper vent panel, wherein the upper vent panel is configured to extend above the top panel when the container is formed.

14. A container in accordance with claim 13, wherein the first vent panel is of equal or greater width than the second vent panel.

15. A container in accordance with claim 13, wherein the at least one venting assembly comprises a length that is equal to or less than a length of the top panel.

16. A container in accordance with claim 13, wherein each partially free side edge is angled outwardly to an apex.

17. A container in accordance with claim 16, wherein the at least one venting assembly further comprises a fold line extending between the first vent panel and the second vent panel, and the apex is offset from the fold line.

18. A container in accordance with claim 13, wherein the at least one venting assembly comprises a length that is approximately one-half of a length of the top panel.

19. A container in accordance with claim 13, the container further comprising a front tuck flap extending from a front edge of the top panel.

20. A container in accordance with claim 19, wherein an exterior surface of the front tuck flap is engaged in a friction fit with an interior surface of a front panel when the container is formed.

21. A container in accordance with claim 13, wherein an exterior surface of a first top side panel is engaged in a friction fit with an interior surface of a first bottom side panel when the container is formed.

22. A container in accordance with claim 13, wherein the openings at each end of the at least one venting assembly enable airflow communication between a cavity of the container and an ambient environment.

23. A container in accordance with claim 13, the container further comprising one or more front panel tabs and a bottom panel, wherein the one or more front panel tabs are configured to extend downwardly below the bottom panel to form one or more support structures to facilitate stacking containers one on top of another.

24. A container in accordance with claim 23, wherein the one or more front panel tabs are configured to function in combination with the at least one venting assembly to create space between stacked containers to facilitate airflow.

* * * * *